US010028368B2

(12) United States Patent
Boulos et al.

(10) Patent No.: US 10,028,368 B2
(45) Date of Patent: Jul. 17, 2018

(54) INDUCTION PLASMA TORCH WITH HIGHER PLASMA ENERGY DENSITY

(71) Applicant: TEKNA PLASMA SYSTEMS INC., Sherbrooke (CA)

(72) Inventors: Maher I. Boulos, Sherbrooke (CA); Jerzy W. Jurewicz, Sherbrooke (CA); Nicolas Dignard, Sherbrooke (CA); Alexandre Auger, St-Adrien de Ham (CA); Sébastien Thellend, Sherbrooke (CA)

(73) Assignee: Tekna Plasma Systems, Inc., Sherbrooke (CA)

( * ) Notice: Subject to any disclaimer, the term of this patent is extended or adjusted under 35 U.S.C. 154(b) by 0 days.

(21) Appl. No.: 15/194,815

(22) Filed: Jun. 28, 2016

(65) Prior Publication Data

US 2016/0381777 A1 Dec. 29, 2016

Related U.S. Application Data

(60) Provisional application No. 62/185,799, filed on Jun. 29, 2015.

(51) Int. Cl.
*H05H 1/28* (2006.01)
*H05H 1/30* (2006.01)

(52) U.S. Cl.
CPC ..... *H05H 1/28* (2013.01); *H05H 1/30* (2013.01)

(58) Field of Classification Search
CPC ..... H05H 1/28; H05H 1/30
(Continued)

(56) References Cited

U.S. PATENT DOCUMENTS 3,041,672 A 7/1962 Lyle
3,891,824 A 6/1975 Essers et al.
(Continued)

FOREIGN PATENT DOCUMENTS

CA 2183290 A1 2/1997
DE 4102101 A1 7/1992
(Continued)

OTHER PUBLICATIONS

Supplemental Prior Art Submission Under 34.1(1) of the Patent Act for Canadian Patent Application No. 2,912,282, Apr. 19, 2017, 14 pgs.

(Continued)

*Primary Examiner* — Christopher Raabe
(74) *Attorney, Agent, or Firm* — K&L Gates LLP

(57) ABSTRACT

An induction plasma torch comprises a tubular torch body, a tubular insert, a plasma confinement tube and an annular channel. The tubular torch body has upstream and downstream sections defining respective inner surfaces. The tubular insert is mounted to the inner surface of the downstream section of the tubular torch body. The plasma confinement tube is disposed in the tubular torch body, coaxial therewith. The plasma confinement tube has a tubular wall having a thickness tapering off in an axial direction of plasma flow. The annular channel is defined between, on one hand, the inner surface of the upstream section of the tubular torch body and an inner surface of the insert and, on the other hand, an outer surface of the tubular wall of the plasma confinement tube. The cooling channel carries a fluid for cooling the plasma confinement tube.

25 Claims, 9 Drawing Sheets

(58) Field of Classification Search
USPC ..... 313/36
See application file for complete search history.

(56) References Cited

U.S. PATENT DOCUMENTS

| | | | | |
|---|---|---|---|---|
| 4,374,075 | A | 2/1983 | Yolton et al. | |
| 4,958,057 | A * | 9/1990 | Shiraishi | H05H 1/34 219/121.48 |
| 5,147,448 | A | 9/1992 | Roberts et al. | |
| 5,200,595 | A | 4/1993 | Boulos et al. | |
| 5,277,705 | A | 1/1994 | Anderson et al. | |
| 5,340,961 | A | 8/1994 | Bebber et al. | |
| 5,442,153 | A | 8/1995 | Marantz et al. | |
| 5,560,844 | A | 10/1996 | Boulos et al. | |
| 5,707,419 | A | 1/1998 | Tsantrizos et al. | |
| 5,808,270 | A | 9/1998 | Marantz et al. | |
| 5,874,134 | A * | 2/1999 | Rao | B01J 19/088 118/302 |
| 5,932,346 | A | 8/1999 | Kent et al. | |
| 5,939,151 | A | 8/1999 | Prichard et al. | |
| 6,142,382 | A | 11/2000 | Ting et al. | |
| 6,162,382 | A | 12/2000 | Kent et al. | |
| 6,365,867 | B1 | 4/2002 | Hooper | |
| 6,693,253 | B2 | 2/2004 | Boulos et al. | |
| 6,919,527 | B2 | 7/2005 | Boulos et al. | |
| 7,022,155 | B2 | 4/2006 | Deegan et al. | |
| 7,465,430 | B2 * | 12/2008 | Plischke | B01J 19/088 106/437 |
| 2002/0168466 | A1 | 11/2002 | Tapphorn et al. | |
| 2003/0080097 | A1 | 5/2003 | Boulos et al. | |
| 2005/0118090 | A1 | 6/2005 | Shaffer et al. | |
| 2012/0160813 | A1 | 6/2012 | Kowalsky et al. | |
| 2012/0261390 | A1 | 10/2012 | Boulos et al. | |
| 2015/0274566 | A1 | 10/2015 | Boughton | |
| 2016/0347641 | A1 | 12/2016 | Boughton | |

FOREIGN PATENT DOCUMENTS

| | | | |
|---|---|---|---|
| WO | 2011/054113 | A1 | 5/2011 |
| WO | 2016191854 | A1 | 12/2016 |
| WO | 2017/011900 | A1 | 1/2017 |
| WO | 2017011900 | A1 | 1/2017 |

OTHER PUBLICATIONS

PCT International Search Report and Written Opinion of the International Searching Authority for International Application No. PCT/CA2016/050754, dated Oct. 26, 2016, 11 pgs.

NASA Tech Brief, Lewis Research Center, "Advances in Induction-Heated Plasma Torch Technology", May 1972, 2 pages.

Soucy et al., "Heat and mass transfer during in-flight nitridation of molybdenum disilicide powder in an induction plasma reactor," Materials Science and Engineering A300 (2001) 226-234.

Communication from CIPO dated Jan. 25, 2017 referencing Supplemental Prior Art Submission Under S.34.1(1) of the Patent Act dated Jan. 18, 2017 for Canadian Patent Application No. 2,912,282, 4 pages.

Raymor AP&C: Leading the way with plasma atomised TI spherical powders for MIM, Powder Injection Moulding International, 5(4):55-57, Dec. 2011.

Maher I. Boulos "Thermal Plasma Processing" IEEE Translations on Plasma Science, [1991], vol. 19, No. 6, pp. 1078-1089.

Franz et al., "Recent Advances of Titanium Alloy Powder Production by Ceramic-free Inert Gas Atomization," Proc. Titanium, International Titanium Association, Las Vegas, NV, USA, 2008, 14 pgs.

Hohmann et al., "Experience on Powder Production by Crucible Free Induction Drip Melting Combined with Inert Gas Atomizing," Advances in Powder Metallurgy, Metal Powder Industries Federation, N.Y., 1989, pp. 153-160.

Fauchais et al., "Thermal Sprayed Coatings Used Against Corrosion and Corrosive Wear," Advanced Plasma Spray Applications, Dr. Hamid Jazi (Ed.), ISBN:978-953-51-0349-3, pp. 3-39, 2012.

Pleier et al., "EIGA—An Innovataive Production Method for Metal Powder from Reactive and Refractory Alloys," ALD Vacuum Technologies, 2004, 7 pgs.

ALD Vacuum Technologies GmbH, Ceramic-Free Metal Powder Production for Reactive and Refractory Metals, MetaCom/Eiga_e/05.11, 2011, 4 pgs.

* cited by examiner

INDUCTION PLASMA TORCH WITH HIGHER PLASMA ENERGY DENSITY

CROSS-REFERENCE TO RELATED APPLICATIONS

This application claims priority to and the benefit of U.S. provisional patent application No. 62/185,799, filed on Jun. 29, 2015, the entire contents of which are hereby incorporated by reference herein.

TECHNICAL FIELD

The present disclosure relates to the field of induction plasma torches. More specifically, the present disclosure relates to an induction plasma torch producing higher plasma energy density while reducing stray-arcing.

BACKGROUND

Over the past few years, considerable improvements have been achieved in the design and performance of inductively coupled plasma torches, the so-called induction plasma torches. Induction plasma torches are currently used worldwide for a wide range of applications, ranging from laboratory R&D to industrial scale production of high purity, high added value materials.

Induction plasma torches have attracted increasing attention as a valuable tool for synthesis of materials and processing under high temperature plasma conditions. The basic concept behind the operation of induction plasma torches has been known for more than sixty years and has evolved steadily form a laboratory tool to an industrial, high power device.

FIG. 1 is a schematic illustration of the structure and operation of an example of induction plasma torch 100. The induction plasma torch 100 comprises a plasma confinement tube 102 which may, for example, be made of high-temperature-resistant and high thermal conductivity ceramic material. The plasma confinement tube 102 is surrounded by a coaxial, water-cooled induction coil 104 embedded in a coaxial, tubular torch body 106. A high frequency electrical current is supplied to the induction coil 104 through electric terminals 105. A gas distributor head (not shown) supplies a plasma gas 108 axially and centrally into an inner space of the plasma confinement tube 102 to produce a plasma 110. Variants may include injection of a sheath gas 112 flowing along the inner surface of the plasma confinement tube 102 to surround the plasma 110. A function of the sheath gas 112 it to provide some level of heat insulation between the plasma 110 and the inner surface of the plasma confinement tube 102. The induction plasma torch 100 may be used, in particular but not exclusively, to process powder material 114 injected centrally within the plasma confinement tube 102.

In operation, the high frequency electrical current flowing though the induction coil 104 creates within the plasma confinement tube 102 a generally axial high frequency magnetic field 120. The energy of this magnetic field 120 causes electrical breakdown of the plasma gas 108 present in the plasma confinement tube 102. Once electrical breakdown and plasma ignition is achieved, a tangential current is induced into the plasma gas in a region 122 within the plasma confinement tube 102 at the level where the induction coil 104 is located. This induced, tangential current is responsible for heating the plasma gas 108 in the plasma confinement tube 102 and sustaining the plasma gas discharge forming the plasma 110.

Numerous designs of induction plasma torches have been developed. Examples are described in the following patent publications: U.S. Pat. No. 5,200,595 (Apr. 6, 1993), U.S. Pat. No. 5,560,844 (Oct. 1, 1996), U.S. Pat. No. 6,693,253 B2 (Feb. 17, 2004), U.S. Pat. No. 6,919,527 B2 (Jul. 19, 2005) and US patent publication 2012/0261390 A1 (Oct. 18, 2012). The contents of all these references are incorporated by reference herein in their entirety.

Energy density in the plasma 110 is defined as the ratio of the energy coupled into the plasma 110 in region 122, to the volume of a discharge cavity as defined by the inner surface (i.e. boundary) of the plasma confinement tube 102 and the height of the induction coil 104. An increase of the energy density in the plasma 110 is manifested by an increase of the bulk specific enthalpy of the plasma, as well as by an increase of a corresponding average temperature of the plasma 110 at an exit 124 of the induction plasma torch 100. Unfortunately, this increase of the energy density is also accompanied by an increase in a heat flux to the inner surface of the plasma confinement tube 102, thereby causing an increase of the temperature of its inner surface and consequently the chance of tube failure.

To reduce the temperature of the inner surface of plasma confinement tube, a solution comprises the use of a high thermal conductivity ceramic material in the manufacture of the plasma confinement tube and the flow of a cooling fluid at high velocity in an annular channel surrounding the outer surface of the plasma confinement tube. However, despite the addition of these features, the maximum energy density of the plasma in an induction plasma torch is still limited by the maximum temperature that the high thermal conductivity ceramic material of the plasma confinement tube can withstand while keeping its structural integrity.

Another problem encountered when using induction plasma torches such as 100 in FIG. 1 is the creation of stray-arcing between (a) the plasma gas discharge 110 and (b) an exit nozzle (not shown in FIG. 1) of the induction plasma torch 100 and/or the body of a reactor (not shown in FIG. 1) on which the induction plasma torch 100 is mounted.

Therefore, there is a need for increasing the plasma energy density while, if not eliminating, substantially reducing stray-arcing in induction plasma torches.

SUMMARY

According to the present disclosure, there is provided an induction plasma torch, comprising: a tubular torch body having an upstream section and a downstream section, the upstream and downstream sections defining respective inner surfaces. A plasma confinement tube is disposed within the tubular torch body, coaxial with the tubular torch body, and has an inner surface of constant inner diameter and an outer surface. The plasma confinement tube has a tubular wall with a thickness tapering off in an axial direction of plasma flow over at least a section of the plasma confinement tube. A tubular insert is mounted to the inner surface of the downstream section of the tubular torch body, the tubular insert having an inner surface. An annular channel is defined between (a) the inner surface of the upstream section of the tubular torch body and the inner surface of the tubular insert, and (b) the outer surface of the plasma confinement tube, the annular channel being configured to conduct a cooling fluid for cooling the plasma confinement tube.

According to the present disclosure, there is also provided an induction plasma torch, comprising a tubular torch body having an upstream section, a central section and a downstream section, the upstream, central and downstream sections defining respective inner surfaces. A plasma confinement tube is disposed within the tubular torch body, coaxial with the tubular torch body, and has an inner surface of constant inner diameter and an outer surface. The plasma confinement tube has a tubular wall with a thickness tapering off in an axial direction of plasma flow over at least a section of the plasma confinement tube. A tubular insert is mounted to the inner surface of the downstream section of the tubular torch body, the tubular insert having an inner surface. An annular channel is defined between (a) the inner surface of the upstream section of the tubular torch body, the inner surface of the central section of the tubular torch body, and the inner surface of the tubular insert, and (b) the outer surface of the plasma confinement tube, the annular channel being configured to conduct a cooling fluid for cooling the plasma confinement tube.

According to the present disclosure, there is also provided a method of removing the plasma confinement tube from the above described induction plasma torch, comprising simultaneously pulling the plasma confinement tube and the tubular insert in the axial direction of plasma flow out of the tubular torch body. The method of removing the plasma confinement tube from the induction plasma torch may comprise: removing an annular plasma exit nozzle mounted to a downstream end of the tubular torch body before simultaneously pulling the plasma confinement tube and the tubular insert in the axial direction of plasma flow out of the tubular torch body; and dismantling the tubular insert made of at least two complementary sections for encircling the plasma confinement tube, dismantling the tubular insert comprising separating the at least two complementary sections apart from each other.

The present disclosure further relates to a method of installing the plasma confinement tube on the above described induction plasma torch, comprising simultaneously introducing the plasma confinement tube and the tubular insert into the tubular torch body in an axial direction opposite to the direction of plasma flow. The method of installing the plasma confinement tube from the induction plasma torch may comprise: assembling the tubular insert made of at least two complementary sections for encircling the plasma confinement tube, assembling the tubular insert comprising assembling the at least two complementary sections with each other around the plasma confinement tube; and mounting an annular plasma exit nozzle to a downstream end of the tubular torch body to position and retain the plasma confinement tube and the tubular insert in the tubular torch body.

The present disclosure still further relates to a tubular torch body for an induction plasma torch, comprising an inner wall and an inner capacitive shield including a layer of electrically conductive material embedded in the inner wall of the tubular torch body. The layer of conductive material is segmented into axial strips and defines a ring for interconnecting upstream ends of the axial strips. The capacitive shield is machined along with the inner wall of the tubular torch body to expose the layer of electrically conductive material and produce a smooth surface of the inner wall of the tubular torch body.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the different figures of the drawings.

DETAILED DESCRIPTION

Figure 1:
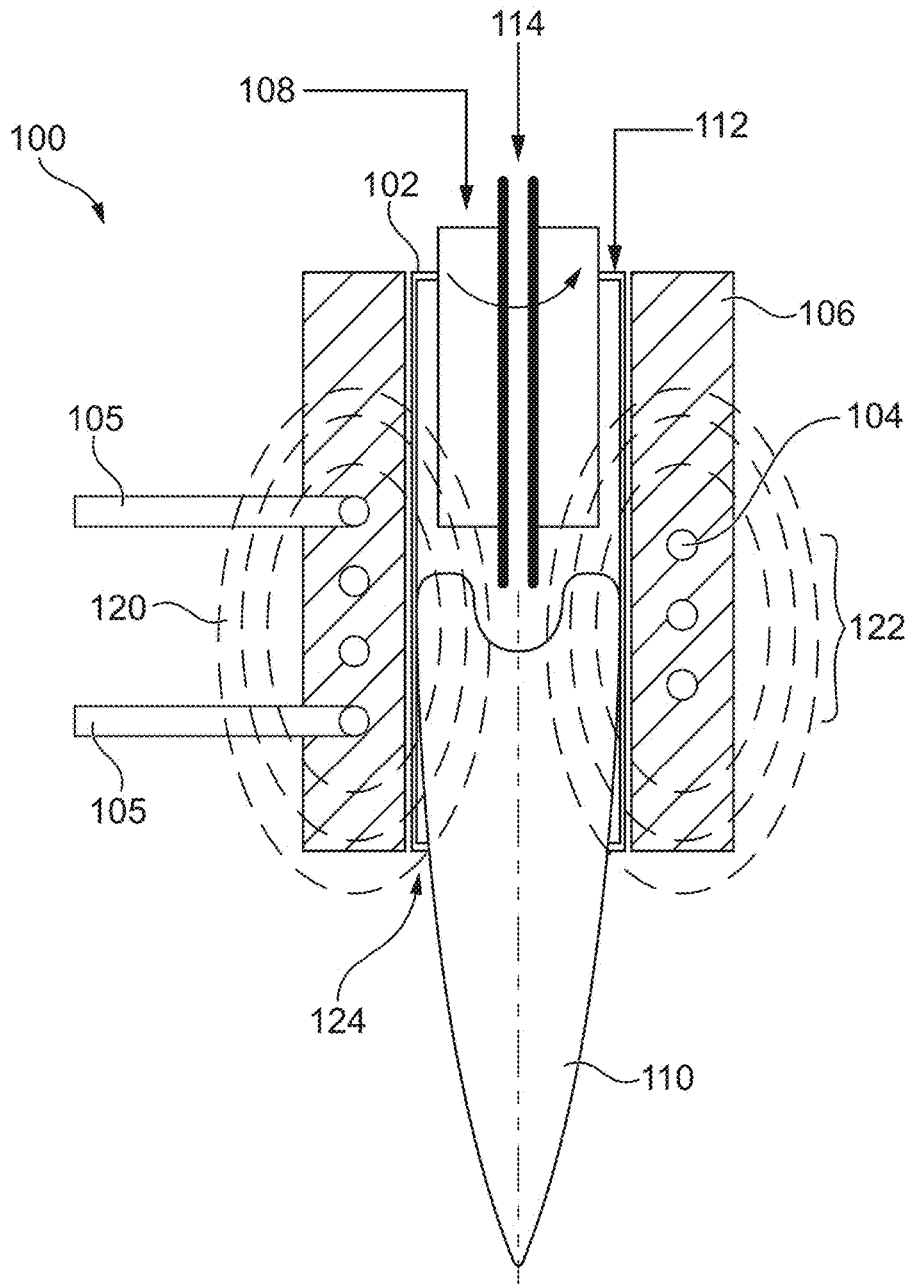
FIG. 1 is a schematic representation of an example of induction plasma torch.

Various aspects of the present disclosure generally address one or more of the needs to increase energy density in plasma while, if not eliminating, substantially reducing stray-arcing in induction plasma torches.

Specifically, the present disclosure describes improvements in induction plasma torches allowing for their operation at higher plasma energy densities when compared to prior induction plasma torches. At the same time, these improvements also reduce capacitive energy coupling to plasma gas discharge so that the creation of stray-arcing is if not eliminated, substantially reduced.

The present disclosure describes control of temperature of the inner surface of the plasma confinement tube of an induction plasma torch using a gradual reduction of the thickness of its tubular wall. The tubular wall is thicker at an upstream end, where the plasma discharge is initiated, and the wall thickness tapers off in the downstream direction. Generally stated, the thickness of the tubular wall of the plasma confinement tube is in inverse proportion to the local heat flux distribution on the tubular wall of the plasma confinement tube.

An annular channel, having a generally constant thickness, is defined around an outer surface of the tubular wall of the plasma confinement tube. Water such as de-ionized water, or another cooling fluid flows within the annular channel to control the temperature of the plasma confinement tube. For cooling efficiency, the annular channel has a small and generally constant thickness to ensure a rapid and constant flow of the cooling fluid.

The plasma confinement tube is mounted within a tubular torch body and is inserted in the tubular torch body from a downstream end thereof. The plasma confinement tube, having a larger outer diameter at both its upstream and downstream ends compared to its central region would be difficult to insert in the torch body while keeping a narrow gap of the annular channel to ensure an efficient cooling of the outer surface of the plasma confinement tube. To overcome this difficulty, the tubular torch body is constructed, at least in its downstream section, with an internal diameter that is larger than what is required for defining the annular channel. As a result, the tubular torch body has a first inner surface in an upstream section that is configured for forming an upstream part of the annular channel between this first inner surface and the outer surface of the plasma confinement tube. The tubular torch body has a second inner surface of larger diameter in its downstream section. A split cylindrical insert can be mounted to the second inner surface in the downstream section of the tubular torch body, abutting on a shoulder between the first and second inner surfaces. The insert is configured for being inserted in and mounted to the tubular torch body along with the plasma confinement tube. A downstream part of the annular, cooling channel is formed between an inner surface of the insert and the outer surface of the plasma confinement tube.

Figure 2:
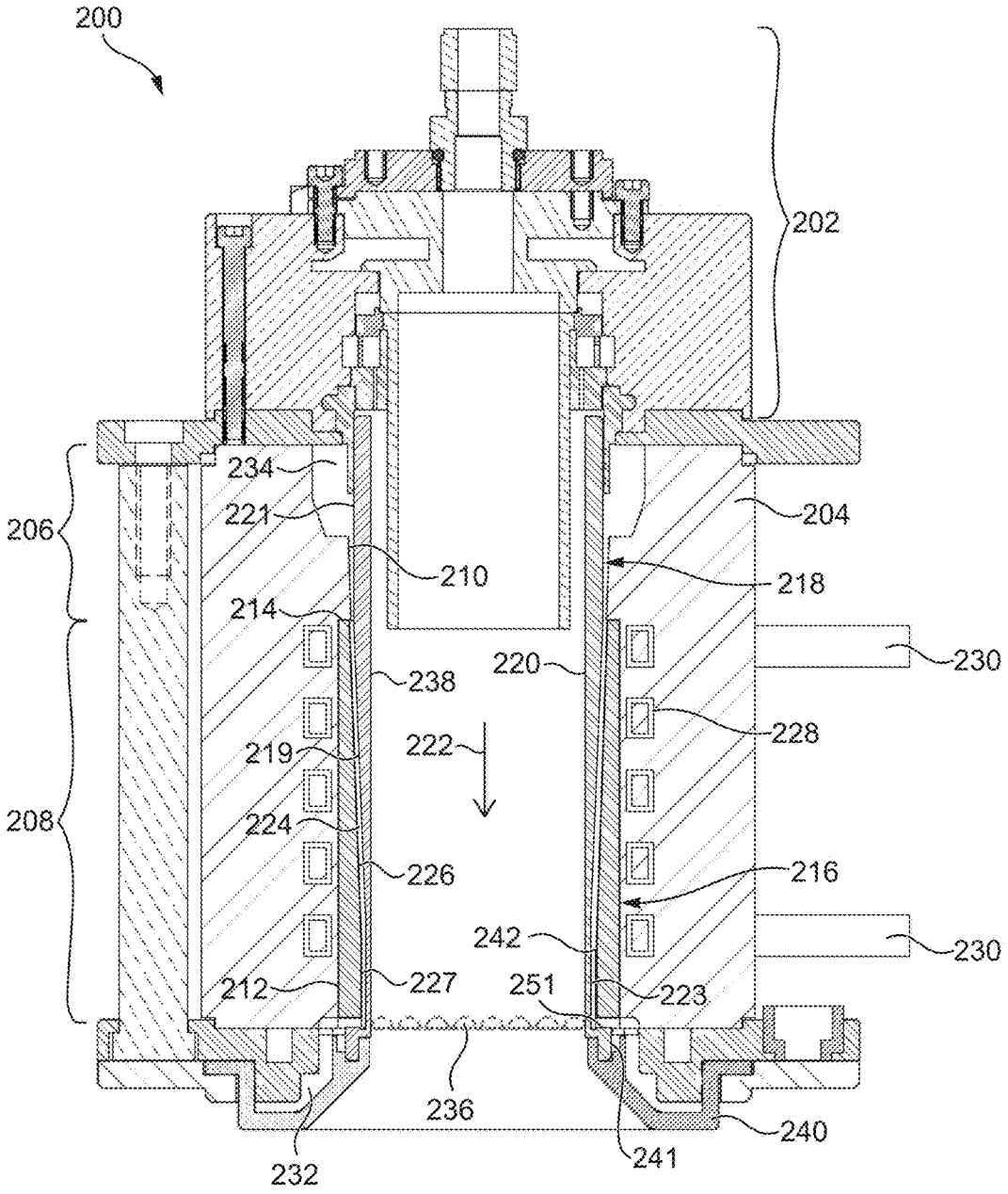
FIG. 2 is a front elevation, cross-sectional view of an induction plasma torch having a tubular insert according to an embodiment.
Figure 3:
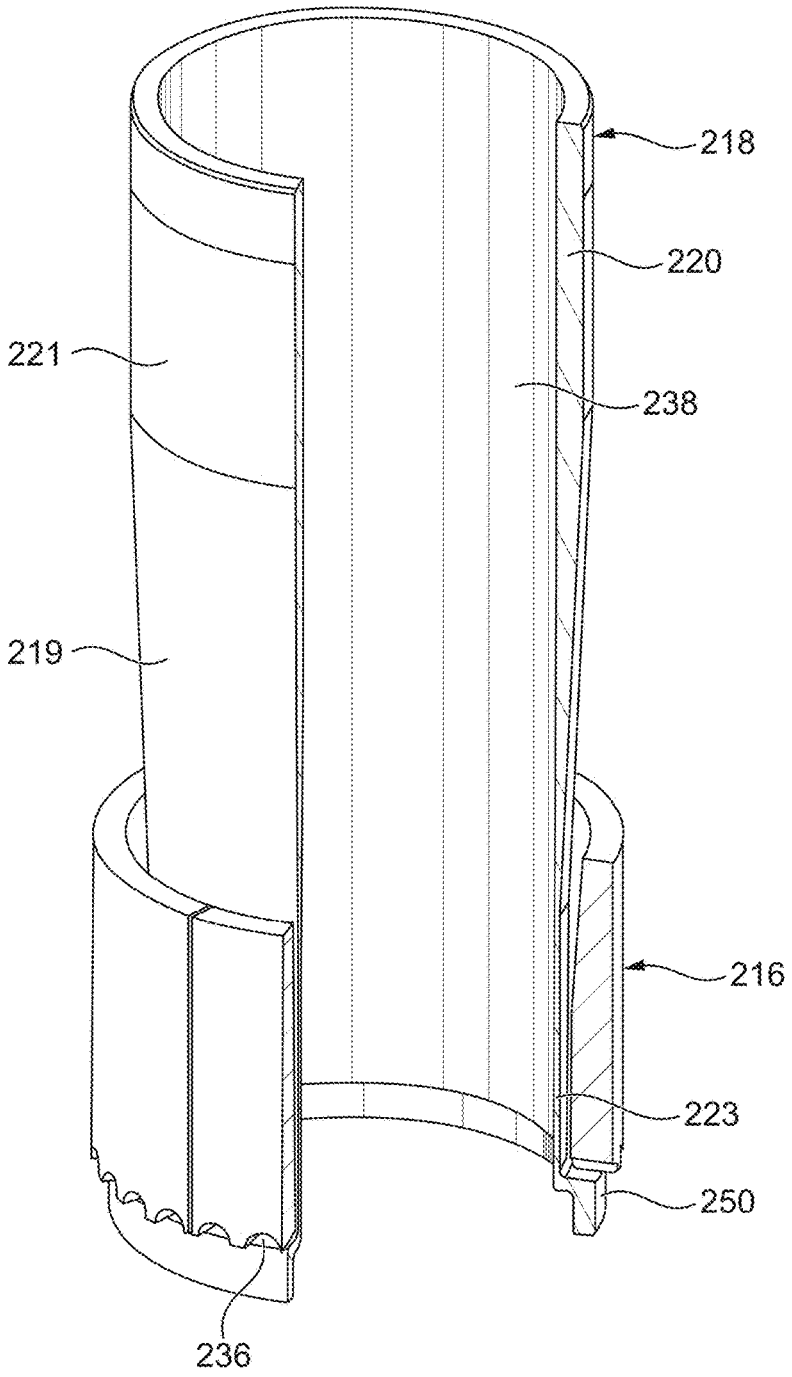
FIG. 3 is a perspective, partial cutaway view of a plasma confinement tube and the tubular insert of the induction plasma torch of FIG. 2.

Referring now to the drawings, FIG. 2 is a front elevation, cross-sectional view of an induction plasma torch 200 having an insert 216 according to an embodiment. FIG. 3 is a perspective, partial cutaway view of a plasma confinement tube 218 and of the insert 216 of the induction plasma torch 200 of FIG. 2.

Referring at once to FIGS. 2 and 3, the induction plasma torch 200 comprises a tubular torch body 204 which may, without limitation, be made of cast ceramic or of a polymer matrix composite. The tubular torch body 204 is also formed with an upstream section 206 and a downstream section 208. The upstream section 206 defines an inner surface 210 of smaller diameter and the downstream section 208 defines an inner surface 212 of larger diameter. An annular shoulder 214 separates the inner surface 210 of the upstream section 206 and the inner surface 212 of the downstream section 208.

The induction plasma torch 200 also comprises a gas distributor head, generally shown at 202. The gas distributor head 202 is mounted to an upstream end of the tubular torch body 204 of the induction plasma torch 200. The gas distributor head 202 is designed to supply, in particular but not exclusively, the above mentioned plasma gas and sheath gas to the induction plasma torch 200. The induction plasma torch 200 further comprises an annular, for example circular or oval shaped plasma exit nozzle 240 mounted to a downstream end of the tubular torch body 204. The gas distributor head 202 and the plasma exit nozzle 240 are well-known in the field of induction plasma torches and, for that reason, will not be further described in the present specification.

The insert 216 is tubular and made, for example of two semi-cylindrical sections of a split cylinder. The tubular insert 216 is positioned on the inner surface 212 of the downstream section 208 of the tubular torch body 204. Also the insert 216 has an upstream end abutting on the annular shoulder 214 and a downstream end. As illustrated, the insert 216 has (a) an outer, constant diameter corresponding to the inner constant diameter of the inner surface 212 of the downstream section 208 of the tubular torch body 204 and (b) an inner diameter that gradually reduces from the upstream end in an axial direction 222 of plasma flow to increase the thickness of the tubular insert 216 in the same direction and form a frusto-conical inner surface 226 up to a point 242 where the inner diameter is kept constant to keep the thickness of the tubular insert 216 constant and form an inner cylindrical surface 227. The insert may be made of Teflon™ or of another material having similar or suitable physical properties.

The induction plasma torch 200 comprises a plasma confinement tube 218, which may be made of a high-temperature-resistant and high thermal conductivity ceramic material. The plasma confinement tube 218 is disposed within the tubular torch body 204, coaxial with this tubular torch body 204, between the gas distributor head 202 and the plasma exit nozzle 240. The plasma confinement tube 218 has a constant, inner diameter and, for example in the region of an induction coil 228, an outer diameter that gradually reduces in the axial direction 222 of plasma flow to form a frusto-conical portion 219 of an outer surface of the plasma confinement tube 218, thereby tapering off the thickness of a tubular wall 220 of the plasma confinement tube 218 in the same direction. Since tapering off of the thickness of the tubular wall 220 of the plasma confinement tube 218 is, in the illustrated example, restricted in the region of the induction coil 228, the plasma confinement tube 218 comprises an upstream section of larger, constant thickness with an outer cylindrical surface portion 221 of larger diameter and a downstream section of smaller, constant thickness with an outer cylindrical surface portion 223 of smaller diameter.

Annular seats are formed on the gas distributor head 202 and the plasma exit nozzle 240 to receive the corresponding ends of the plasma confinement tube 218 and appropriately position this plasma confinement tube 218 within the tubular torch body 204. In particular, as shown in FIG. 3, the downstream end of the plasma confinement tube 218 comprises an outward, annular shoulder/flange extension 250 to be received in a complementary annular seat 241 of the plasma exit nozzle 240.

An annular channel 224 is defined between, on one hand, the inner surface 210 of the upstream section 206 of the tubular torch body 204 and the inner frusto-conical 226 and cylindrical 227 surfaces of the tubular insert 216 and, on the other hand, the outer surface portions 219, 221 and 223 of the plasma confinement tube 218. The annular channel 224 is configured to receive a cooling fluid (not shown) for cooling the plasma confinement tube 218. Without limitation, the annular channel 224 may have a constant thickness over at least a substantial section of the plasma confinement tube 218 in which plasma is produced. When the annular channel 224 is sufficiently thin, a high velocity flow of cooling fluid can be established therein to efficiently cool the plasma confinement tube 218. A non-limitative example of cooling fluid includes water, such as de-ionized water, or another suitable cooling liquid. Specifically, the cooling fluid is supplied to an annular cooling fluid inlet 232 formed in the plasma exit nozzle 240, flows through the annular channel 224, and evacuates through an annular cooling fluid outlet 234 formed in the tubular torch body 204 and the gas distribution head 202. Without limitation, the cooling fluid flows in the cooling channel 224 in a direction opposite to the axial direction 222 of plasma flow. In the illustrated embodiment, to facilitate passage of the cooling fluid from the annular cooling fluid inlet 232 to the annular channel 224, a plurality of semicircular openings such as 236 are machined on the periphery of the annular downstream end of the insert 216. Other configurations for the passage of the cooling fluid from the annular cooling fluid inlet 232 and the annular channel 224 can also be contemplated.

As illustrated in FIG. 2, the induction plasma torch 200 includes an inductive coupling member, for example the above-mentioned induction coil 228, embedded within the tubular torch body 204 coaxial with this tubular torch body. A high frequency electrical current can be supplied to the induction coil 228 via electrical terminals 230. The induction coil 228 generates a generally axial magnetic field within the plasma confinement tube 218 to apply, as described herein above, energy to the plasma gas present in the plasma confinement tube 218 and cause electrical breakdown of the plasma gas. Once electrical breakdown and plasma ignition is achieved, a tangential current is induced into the plasma gas in the region (see 122 in FIG. 1) of the torch body 204 where the induction coil 228 is embedded. This induced, tangential current is responsible for heating the plasma gas in the plasma confinement tube 218 and for sustaining the plasma gas discharge generating plasma. The induction coil 228 may be made of an electrically conductive tube circular or rectangular (as illustrated in FIG. 2) in cross section for being cooled by means of a flow of cooling fluid established therein through the electrical terminals 230. Again, a non-limitative example of cooling fluid includes water, such as de-ionized water, or another suitable cooling liquid.

FIGS. 2 and 3 show variants of the insert 216 of the induction plasma torch 200. In FIG. 2, the insert 216 is longer and extends along a longer portion of the plasma confinement tube 218, the upstream section 206 of the tubular torch body 204 being shorter than the downstream section 208. In FIG. 3, the insert 216 is shorter and extends along a shorter downstream portion of the plasma confinement tube 218 and, although FIG. 3 does not show the tubular torch body 204, it will be understood that, in this variant, the upstream section 206 of the tubular torch body 204 is longer than the downstream section 208. Those of ordinary skill in the art having recourse to the present disclosure will be able to adapt geometries of the various components of the induction plasma torch 200 as a function of its operational and maintenance needs, including cooling requirements of the plasma confinement tube 218.

In another variant of the induction plasma torch 200, the plasma confinement tube 218 may be made of a material permeable to the cooling fluid flowing through the annular channel 204. A fraction of the cooling fluid may then permeate through the material of the plasma confinement tube 218 to form a film of the cooling fluid on the inner surface 238 of the plasma confinement tube 218. The cooling fluid from the film is vaporized by heat produced in the induction plasma torch 200. Advantageously, the cooling fluid is then selected to form, when vaporized, gas capable of producing plasma.

Figure 4:
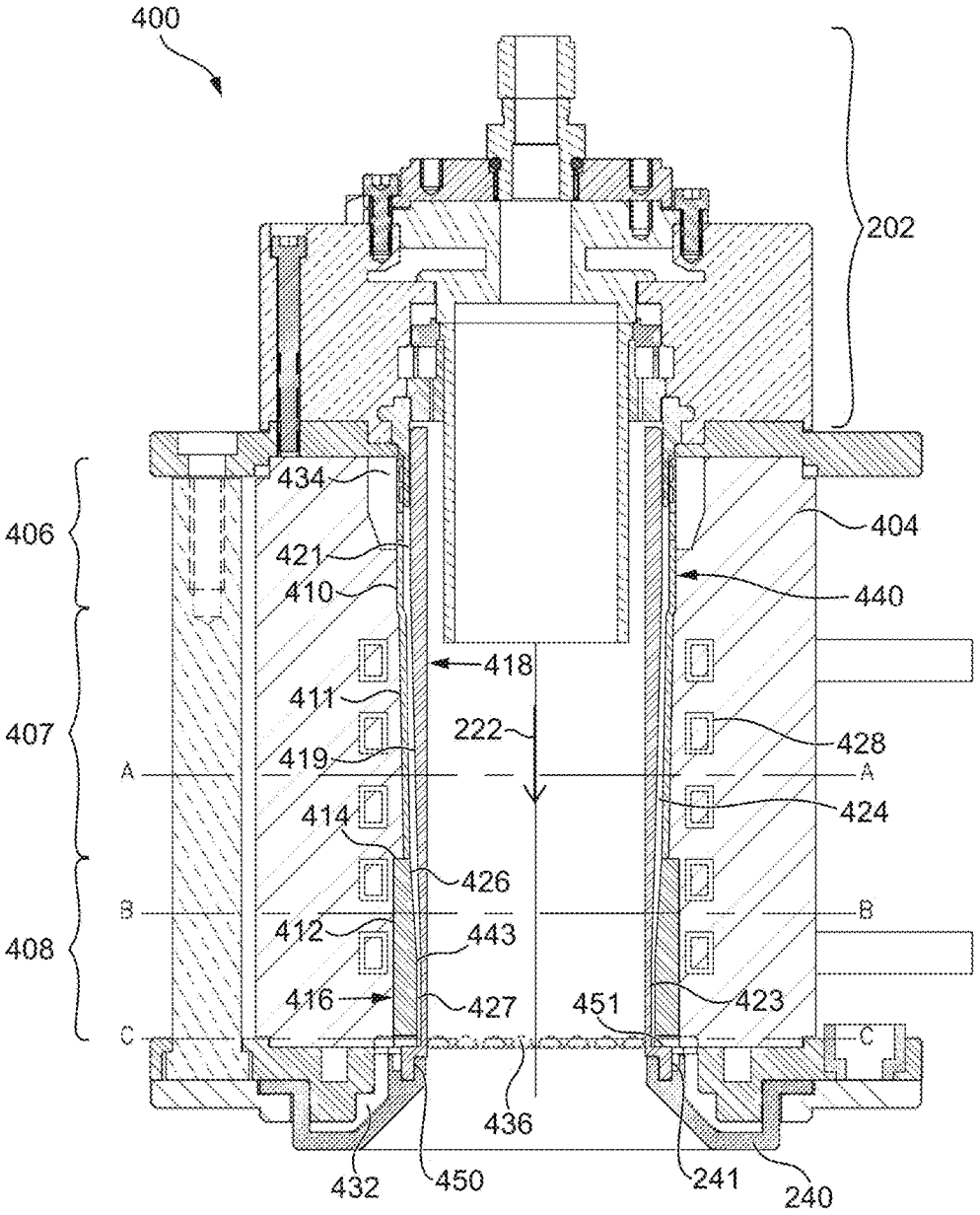
FIG. 4 is a front elevation, cross-sectional view of an induction plasma torch having a tubular insert and a capacitive shield according to another embodiment.
Figure 5:
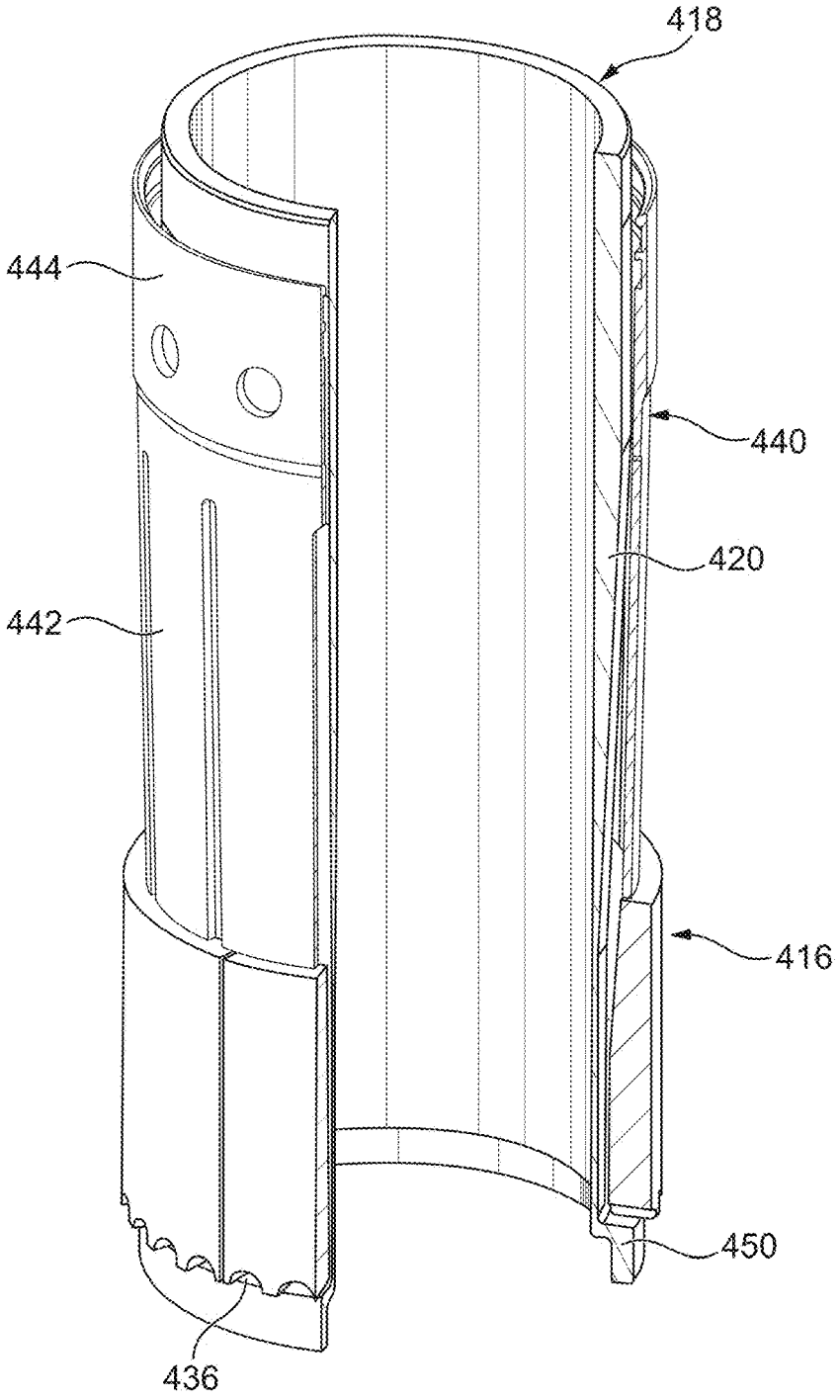
FIG. 5 is a perspective, partial cutaway view of a plasma confinement tube, the tubular insert and the capacitive shield of the induction plasma torch of FIG. 4.
Figure 6:
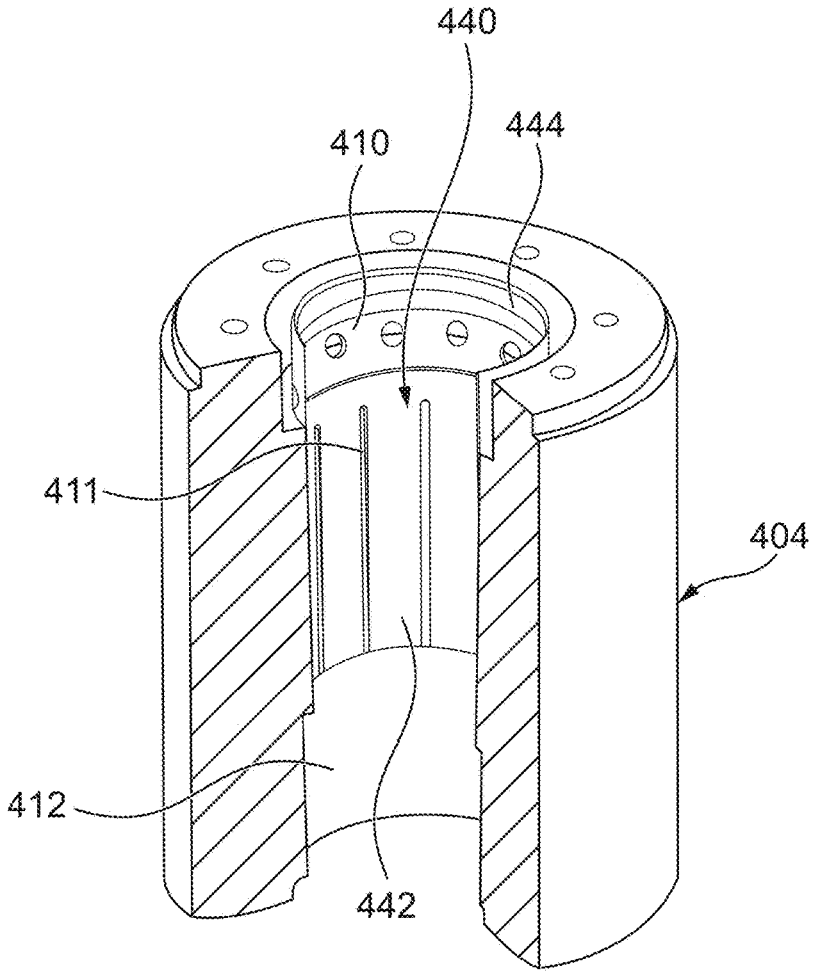
FIG. 6 is a perspective, partial cutaway view of a tubular torch body of the induction plasma torch of FIG. 4.

FIG. 4 is a front elevation, cross-sectional view of an induction plasma torch 400 having an insert 416 and a capacitive shield 440 according to one embodiment. FIG. 5 is a perspective, partial cutaway view of a plasma confinement tube 418, the insert 416 and the capacitive shield 440 of the induction plasma torch 400 of FIG. 4. FIG. 6 is a perspective, partial cutaway view of a tubular torch body 404 of the induction plasma torch 400 of FIG. 4. Referring at once to FIGS. 4-6, an induction plasma torch 400 includes most of the elements of the induction plasma torch 200 described herein above with reference to FIGS. 2 and 3. Same reference numerals are used to identify elements that are identical in both embodiments.

As shown in FIGS. 4-6, the induction plasma torch 400 comprises the tubular torch body 404 which may, without limitation, be made of cast ceramic or of a polymer matrix composite. The tubular torch body 404 is also formed with an upstream section 406, a central section 407, and a downstream section 408. The upstream section 406 defines an inner cylindrical surface 410. The central section 407 has an inner diameter gradually reducing from the upstream section 406 to an annular shoulder 414 to form a frusto-conical surface 411. Finally, the downstream section 408 defines an inner cylindrical surface 412. The annular shoulder 414 separates the inner frusto-conical surface 411 of the central section 407 and the inner cylindrical surface 412 of the downstream section 408.

The induction plasma torch 400 also comprises a gas distributor head, generally shown at 202. The gas distributor head 202 is mounted to an upstream end of the tubular torch body 404 of the induction plasma torch 400. As described hereinabove, the gas distributor head 202 is designed to supply, in particular but not exclusively, the above mentioned plasma gas and sheath gas to the induction plasma torch 400. The induction plasma torch 400 further comprises an annular, for example circular or oval plasma exit nozzle 240 mounted to a downstream end of the tubular torch body 404. The gas distributor head 202 and the plasma exit nozzle 240 are well-known in the field of induction plasma torches and, for that reason, will not be further described in the present specification.

The insert 416 is tubular and made, for example of two semi-cylindrical sections of a split cylinder. The tubular insert 416 is positioned on the inner surface 412 of the downstream section 408 of the tubular torch body 404. Also the insert 416 has an upstream end abutting on the annular shoulder 414 and a downstream end. As illustrated, the insert 416 has (a) an outer, constant diameter corresponding to the inner constant diameter of the inner surface 412 of the downstream section 408 of the tubular torch body 404 and (b) an inner diameter that gradually reduces from the upstream end in the axial direction 222 of plasma flow to increase the thickness of the tubular insert 416 in the same direction and form a frusto-conical inner surface 426 up to a point 443 where the inner diameter is kept constant to keep the thickness of the tubular insert 416 constant and form an inner cylindrical surface 427. As can be seen in FIG. 4, the thickness of the insert 416 at its upstream end is equal to the width of the annular shoulder 414 whereby the inner frusto-conical surface 411 of the central portion 407 of the tubular torch body 404 forms with the inner frusto-conical surface 426 of the insert 418 a continuous inner frusto-conical face. The insert 416 may be made of Teflon™ or of another material having similar or suitable physical properties.

The induction plasma torch 400 comprises the plasma confinement tube 418. The plasma confinement tube 418, which may be made of a high-temperature-resistant and high thermal conductivity ceramic material, is disposed within the tubular torch body 404, coaxial with this tubular torch body 404, between the gas distributor head 202 and the plasma exit nozzle 240. The plasma confinement tube 418 has a constant, inner diameter and, for example in the region of an induction coil 428, an outer diameter that gradually reduces in the axial direction 222 of plasma flow to form a frusto-conical portion 419 of an outer surface of the plasma confinement tube 418, thereby tapering off the thickness of the tubular wall 420 in the same direction. Since tapering off of the thickness of the tubular wall 420 of the plasma confinement tube 418 is, in the illustrated example, restricted in the region of the induction coil 428, the plasma confinement tube 418 comprises an upstream section of larger, constant thickness with an outer cylindrical surface portion 421 of larger diameter and a downstream section of smaller, constant thickness with an outer cylindrical surface portion 423 of smaller diameter.

As described above, annular seats are formed on the gas distributor head 202 and the plasma exit nozzle 240 to receive the corresponding ends of the plasma confinement tube 418 and appropriately position this plasma confinement tube 418 within the tubular torch body 404. In particular, as shown in FIG. 5, the downstream end of the plasma confinement tube 418 comprises an outward, annular shoulder/flange extension 450 to be received in a complementary annular seat 241 of the plasma exit nozzle 240.

An annular channel 424 is defined between, on one hand, the inner surface 410 of the upstream section 406 of the tubular torch body 404, the inner frusto-conical surface 411 of the central section 407, and the inner frusto-conical 426 and cylindrical 427 surfaces of the insert 416 and, on the other hand, the outer surface portions 419, 412 and 423 of the plasma confinement tube 418. The annular channel 424 is configured to receive a cooling fluid (not shown) for cooling the plasma confinement tube 418. Without limitation, the annular channel 424 may have a constant thickness over at least a substantial section of the plasma confinement tube 418 in which plasma is produced. When the annular channel 424 is sufficiently thin, a high velocity flow of cooling fluid can be established therein to efficiently cool the plasma confinement tube 418. A non-limitative example of cooling fluid includes water, such as de-ionized water, or another suitable cooling liquid. Specifically, the cooling fluid is supplied to an annular cooling fluid inlet 432 formed in the exit nozzle 240, flows through the annular channel 424, and evacuates through an annular cooling fluid outlet 434 formed in the tubular torch body 404 and the gas distribution head 202. Without limitation, the cooling fluid flows in the cooling channel 424 in a direction opposite to the axial direction 222 of plasma flow. In the illustrated embodiment, to facilitate passage of the cooling fluid from the annular cooling fluid inlet 432 to the annular channel 424, a plurality of semicircular openings such as 436 are machined on the periphery of the annular downstream end of the insert 416. Other configurations for the passage of the cooling fluid from the annular cooling fluid inlet 432 and the annular channel 424 can also be contemplated.

As in the embodiment of FIG. 2, the induction plasma torch 400 includes an inductive coupling member, for example the above-mentioned induction coil 428, embedded within the tubular torch body 404 coaxial with this tubular torch body.

The induction plasma torch 400 includes, as illustrated in FIGS. 4-6, the tubular capacitive shield 440 formed of a layer, for example a tube of electrically conductive material, for example metal, embedded in the material of the inner surfaces 410 and 411 of the upstream 406 and central 407 sections of the tubular torch body 404. In one embodiment, the layer, for example tube of electrically conductive material will be thick enough to be machined along with the inner wall of the tubular torch body 404, i.e. the inner surfaces 410 and 411 of the tubular torch body in order to expose the said layer of electrically conductive material on these inner surfaces 410 and 411 and produce a smooth surface of the inner wall of the tubular torch body 404.

The layer, for example tube of electrically conductive material forming the capacitive shield 440 may be segmented into downstream axial strips such as 442 interconnected by an upstream ring 444 located at the top portion of the upstream section 406 of the tubular torch body 404. The capacitive shield 440 may also be simply applied to the inner surface 410 and 411 of the upstream 406 and central 407 sections of the tubular torch body 404.

The inductive coupling member 428 is to a large extent positioned at the level of, and outside the capacitive shield 440. Therefore, the capacitive shield 440 covers a major part of an area of the plasma confinement tube 418 where the flow of plasma gas is subjected to energy from the inductive coupling member 428. The capacitive shield 440, accordingly, will reduce capacitive energy coupling to the plasma gas discharge in the induction plasma torch 400 so that the creation of stray-arcing is, if not eliminated, substantially reduced.

In the above described induction plasma torches 200 and 400, the outward, annular shoulder/flange extension 250/450 is configured to maintain the insert 216/416 in position within the induction plasma torch 200/400. For that purpose, the outward, annular shoulder/flange extension 250/450 defines a shoulder 251/451 abutting on the downstream end of the insert 216/416. Use of the outward, annular shoulder/flange extension 250/450, including the shoulder 251/451, also provides for precise positioning of the plasma confinement tube 218/418 within the tubular torch body 204/404, when positioned in the annular seat 241. Obviously, the outward, annular shoulder/flange extension 250/450, when present, prevents sliding up of the plasma confinement tube 218/418 for removal from the upstream end of the induction plasma torches 200/400.

Figure 7C:
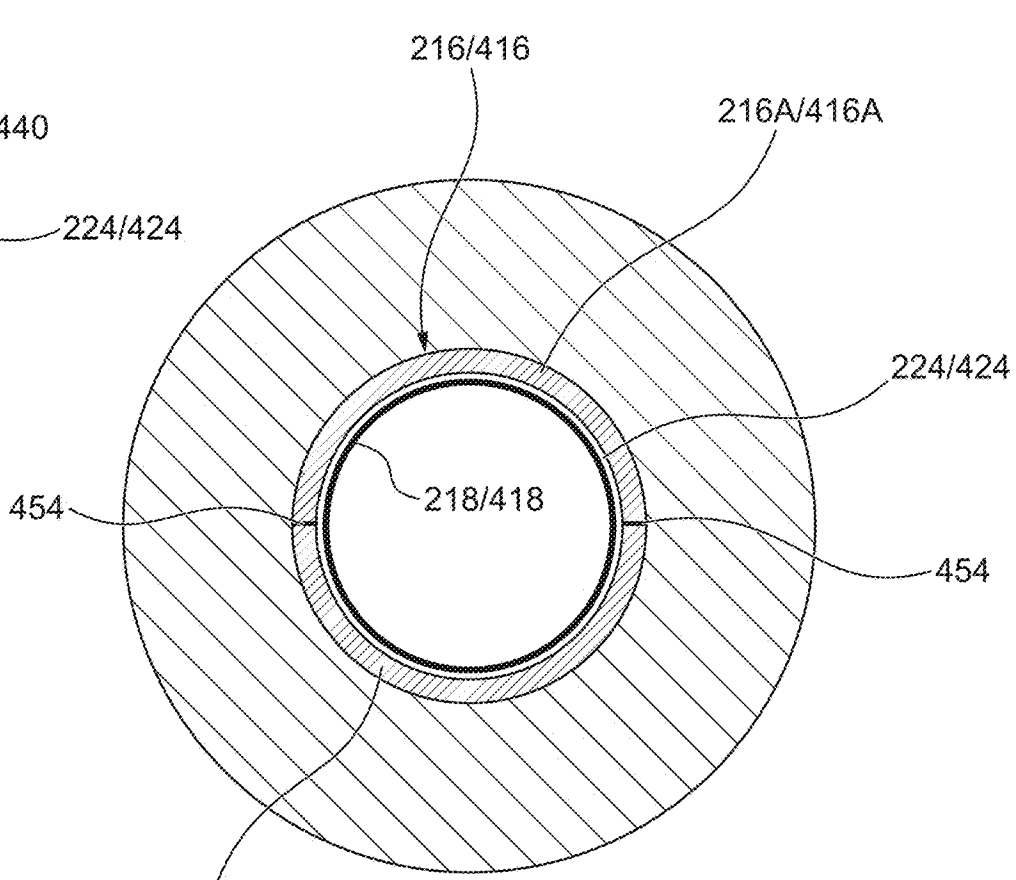
FIGS. 7*a*, 7*b* and 7*c* are cross-sectional views of the induction plasma torch of FIG. 4 respectively taken along lines A-A, B-B and C-C of this figure.
Figure 7A:
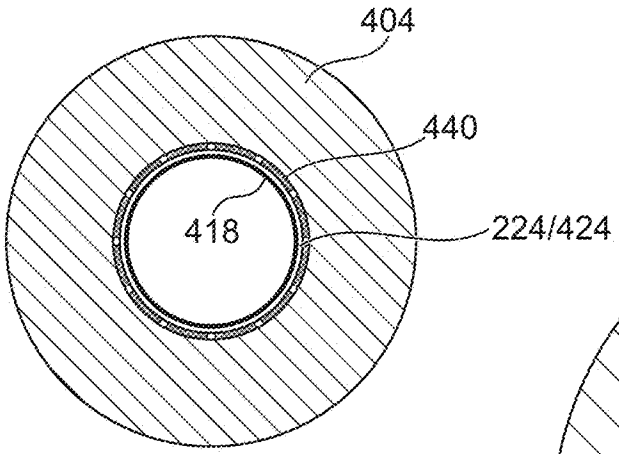
Figure 7B:
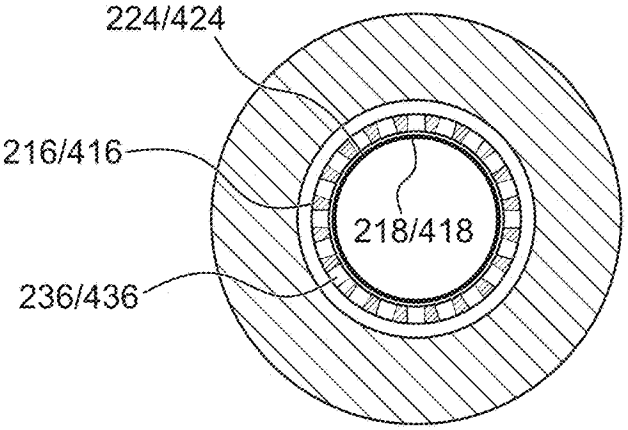

FIGS. 7*a*, 7*b* and 7*c* are cross-sectional views of the induction plasma torch 400 respectively taken along lines A-A, B-B and C-C of FIG. 4.

The capacitive shield 440, which is visible on FIG. 7*a*, in only present in the induction plasma torch 400 of FIG. 4. The views of FIGS. 7*b* and 7*c* are applicable to both induction plasma torches 200 and 400 shown on FIGS. 2 and 4.

FIG. 7*b* illustrates that the insert 216/416 comprises at least two complementary semi-cylindrical sections 216A and 216B/416A and 416B, separated by axial cuts 454. The complementary sections 216A and 216B/416A and 416B fully encircle the plasma confinement tube 218/418 and can be dismantled from the induction plasma torch 200/400 by sliding the plasma confinement tube 218/418 and the insert 216/416 out of the tubular torch body 204/404 through the downstream end of the tubular torch body 204/404 and, then, by detaching them from one another along the axial cuts 454.

FIG. 7*c* shows, in particular, the plurality of semicircular openings such as 236/436 machined and distributed on the periphery of the annular downstream end of the insert 216/416.

Though FIGS. 7*a*, 7*b* and 7*c* are not to scale, they illustrate that the tubular wall of the plasma confinement tube 418 decreases in thickness between the cross sections along lines A-A, B-B and then C-C of FIG. 4. The annular channel 224/424 has a fairly constant thickness at those levels.

In the region of the induction coil 228/428, the variable thickness of the tubular wall 220/420 of the plasma confinement tube 218/418, for a given cross-section along its length, can be calculated as follows:

$$q = \frac{k\Delta T}{\delta_w} \tag{1}$$

wherein:

$\delta_w$ is a thickness of the tubular wall 220/420 at a selected distance from the upstream end of the plasma confinement tube 218/418, expressed in meters;

k is a thermal conductivity of the material forming the plasma confinement tube 218/418, expressed in watts per meter and per Kelvin;

ΔT is an allowable temperature difference across the tubular wall 220/420 of the plasma confinement tube 218/418, expressed in Kelvin;

q is a heat flux to the plasma confinement tube at the selected distance from the upstream end of the plasma confinement tube 218/418, expressed in watts per square meter.

Knowing the heat flux caused by operation of the induction plasma torch 200/400 and knowing the thermal conductivity and a heat tolerance and desired durability of the plasma confinement tube 218/418, it is possible to establish the thickness variation of the plasma confinement tube 218/418 and, from this, the geometrical dimensions of other components of the induction plasma torch 200/400.

Figure 8:
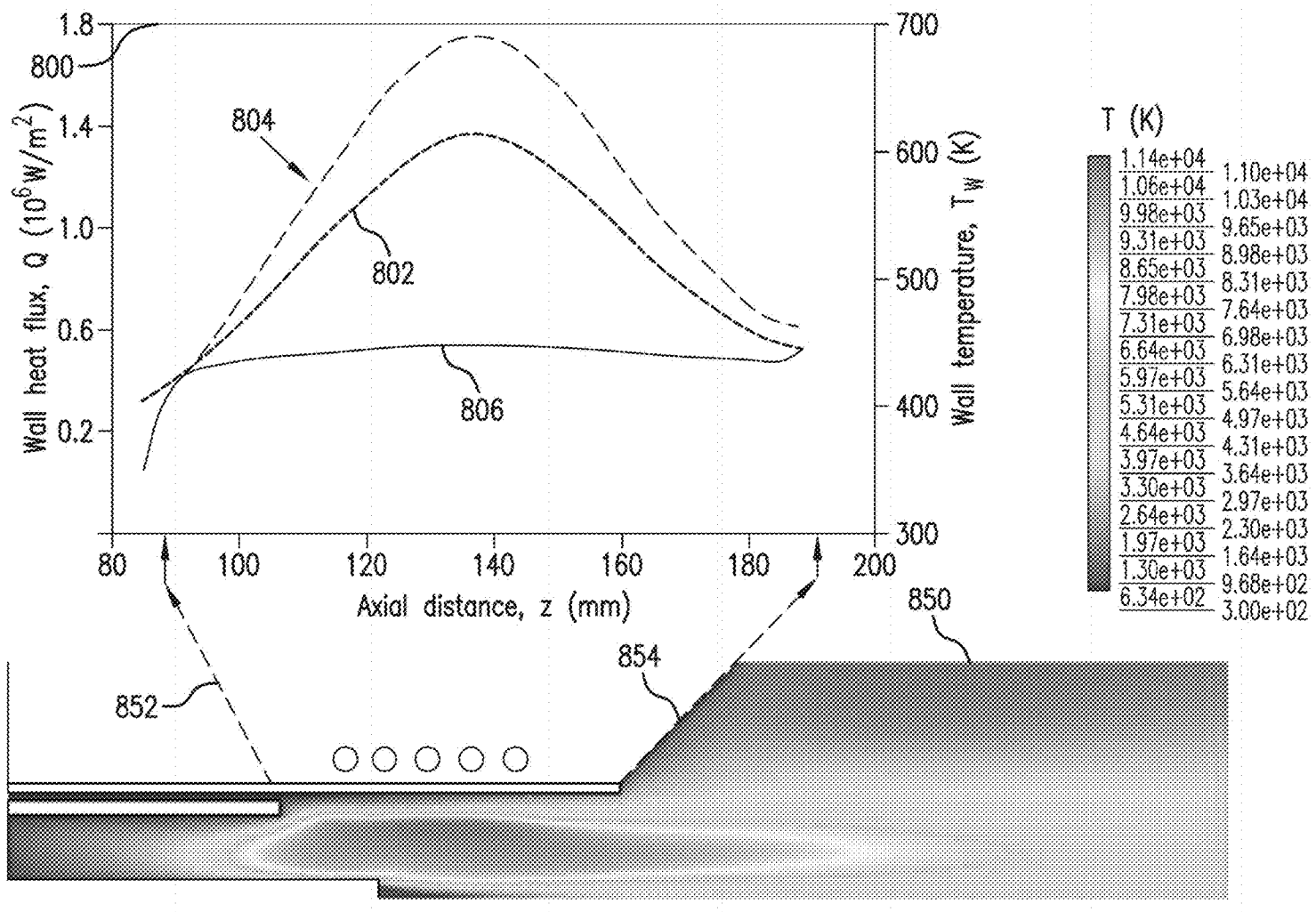
FIG. 8 is a graph showing an axial distribution of heat flux to the tubular wall of (a) a conventional plasma confinement tube and (b) the plasma confinement tube of the induction plasma torch of FIG. 2 or 4, the induction plasma torch operating at a power of 100 kW.

FIG. 8 is a graph showing an axial distribution of heat flux to the tubular wall of (a) a constant-thickness plasma confinement tube and (b) a plasma confinement tube as illustrated in FIG. 2 or 3, the induction plasma torch operating at 100 kW. A model PL-70 induction plasma torch from TEKNA, Sherbrooke, QC, Canada, was used to obtain computational results illustrated in FIG. 8. At first, the computations and measurements were obtained using a standard PL-70 induction plasma torch. A prototype was then made by modifying the PL-70 induction plasma torch using the features introduced in FIGS. 2 and 3. In both cases, an internal diameter of the plasma confinement tube is 70 mm, the plasma is composed of a mixture of argon and hydrogen at atmospheric pressure, and the induction plasma torch operates at a plate power of 100 kW, 65 kW of power being coupled into the plasma discharge.

In FIG. 8, a graph 800 is accompanied by a partial schematic view 850 of parts of the induction plasma torch 200/400. The graph 800 shows on its horizontal axis an axial distance, in millimeters, taken along the length of the plasma confinement tube from its upstream end. Arrows 852 and 854 allow visualizing this axial distance along the partial schematic view 850, in relation to a position of the inductive coupling member 228/428. A first vertical axis, on the left side of the graph 800, provides a heat flux on the tubular wall 220/420 of the plasma confinement tube 204/404, in watts per square meters. A second vertical axis, on the right side of the graph 800, provides a temperature in Kelvin for the tubular wall of the plasma confinement tube. Curve 802 shows variations of the heat flux, reaching a maximum of nearly $1.4\times10^6$ W/m$^2$ around the center of the inductive coupling member 228/428, dropping to about $0.3\times10^6$ W/m$^2$ at the upstream end of the inductive coupling member 228/428 and to about $0.5\times10^6$ W/m$^2$ at the downstream end of the inductive coupling member 228/428.

Using the standard PL-70 induction plasma torch, the temperature of the tubular wall of the plasma confinement tube, shown on temperature curve 804, closely follows a trend of the heat flux curve 802, reaching a maximum value of close to 700K at a position of the maximum heat flux, tapering down, respectively, to about 400 and 500K on the upstream and downstream ends of the inductive coupling member 228/428.

Using the plasma confinement tube with a tapered thickness as shown on FIGS. 2 and 3, the temperature profile of the tubular wall of the plasma confinement tube is significantly flattened, as shown on temperature curve 806. It may be noted that the maximum tubular wall temperature in this case is below 450K, which is considerably lower than the 700K value obtained with a uniform tubular thickness.

Figure 9:
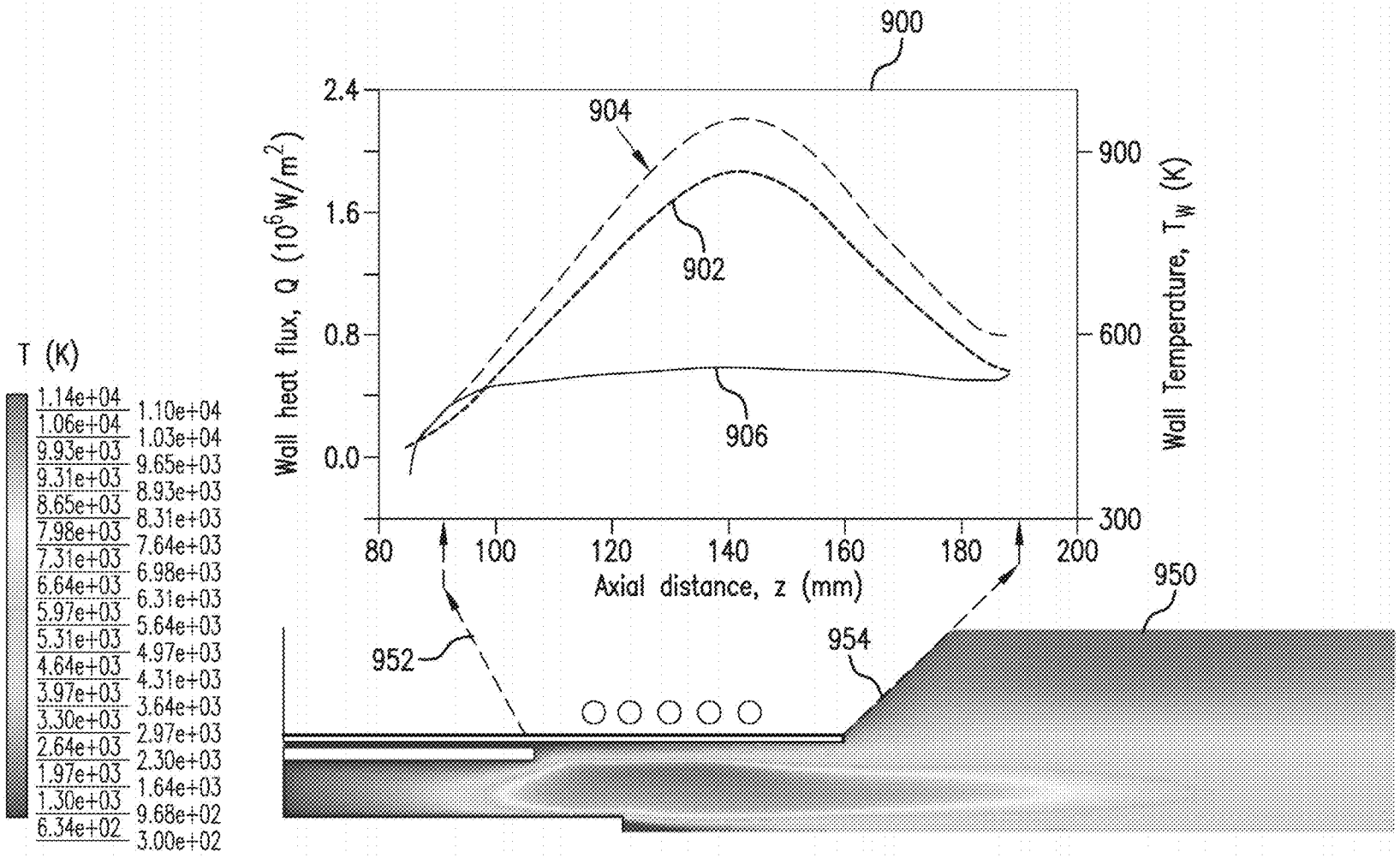
FIG. 9 is a graph showing an axial distribution of heat flux to the tubular wall of (a) a conventional plasma confinement tube and (b) the plasma confinement tube of the induction plasma torch of FIG. 2 or 4, the induction plasma torch operating at a power of 140 kW.

FIG. 9 is a graph showing an axial distribution of heat flux to the tubular wall of (a) a constant-thickness plasma confinement tube and (b) a plasma confinement tube as illustrated in FIG. 2 or 3, the induction plasma torch operating at 140 kW. The same model PL-70 induction plasma torch was used, first with a standard configuration and then using the features introduced in FIGS. 2 and 4, the distinction between FIGS. 8 and 9 being that results were obtained at a higher operating power in the case of FIG. 9.

On FIG. 9, a graph 900 is accompanied by a partial schematic view 950 of parts of the induction plasma torch 200/400. The graph 900 shows on its horizontal axis an axial distance, in millimeters, taken along the length of the plasma confinement tube from its upstream end. Arrows 952 and 954 allow visualizing this axial distance along the partial schematic view 950, in relation to a position of the inductive coupling member 228/428. A first vertical axis, on the left side of the graph 900, provides a heat flux on the tubular wall of the plasma confinement tube, in watts per square meters. A second vertical axis, on the right side of the graph 900, provides a temperature in Kelvin for the tubular wall of the plasma confinement tube. Curve 902 shows variations of the heat flux, reaching a maximum of about $2.2\times10^6$ W/m$^2$ around the center of the inductive coupling member 228/428, dropping to about $0.2\times10^6$ W/m$^2$ at the upstream end of the inductive coupling member 228/428 and to about $0.7\times10^6$ W/m$^2$ at the downstream end of the inductive coupling member 228.

Using the standard PL-70 induction plasma torch, the temperature of the tubular wall of the plasma confinement tube, shown on temperature curve 904, closely follows a trend of the heat flux curve 902, reaching a maximum value of close to 1000K at a position of the maximum heat flux, tapering down, respectively, to about 470K and 600K on the upstream and downstream ends of the inductive coupling member 228/428.

Using the plasma confinement tube with a tapered thickness as shown on FIGS. 2 and 3, despite the higher operating power of the induction plasma torch, the temperature profile of the tubular wall of the plasma confinement tube is still significantly flattened, as shown on temperature curve 906. It may be noted that the maximum tubular wall temperature in this case is about 550K, which is considerably lower than the 1000K value obtained with a uniform tubular wall thickness and which is still lower than the maximum value of 700K obtained at plate power of 100 kW with a plasma confinement tube having uniform tubular wall thickness.

It may be noted that a temperature gradient on the tubular wall of the plasma confinement tube is not substantially impacted by the presence the capacitive shield 440 of FIG. 4 and, as a result, the curve 806 on the graph 800 and the curve 906 on the graph 900 apply to both embodiments of FIGS. 2 and 4. It may also be noted that the temperature curves 804, 806, 904 and 906 were obtained using plasma confinement tubes that are not permeable to cooling fluid.

Although the present technology reduces the extreme heat applied to its tubular wall 220/420, the plasma confinement tube 218/418 is still subject to high temperatures that eventually cause the need for their replacement. The skilled reader will appreciate that a configuration of the induction plasma torch 200/400 without the inserts 216/416 would render replacement of the plasma confinement tube 218/418 very difficult, perhaps impossible in some configurations.

Because the plasma confinement tube 218/418 is thicker at its upstream end, it could not slide down from the tubular torch body 204/404 without colliding on the periphery of the internal surface of the tubular torch body 204/404 if this internal surface was extending with a constant reduction of its diameter to provide a thin annular channel 224/424 having a fairly constant thickness.

A solution in which the internal surface of a torch body would have a constant diameter could allow removal and replacement of the plasma confinement tube, but this solution would perform poorly in terms of cooling because it would make the annular, cooling channel thicker at its bottom end. Another solution in which a plasma confinement tube would be removed by sliding up in the torch body would be manpower extensive at it would require dismounting the distributor head of the induction plasma torch. Additionally, this solution would simply not be workable in the presence of an outward, annular shoulder/flange extension such as 250/450 at the downstream end of the plasma confinement tube.

A method for removing the plasma confinement tube 218/418 of the induction plasma torch 200/400 in which the plasma confinement tube 218/418 includes the outward, annular shoulder/flange extension 250/450, comprises removing the plasma exit nozzle 240 from the tubular torch body 204/404. Removal of the plasma exit nozzle 240 releases the outward, annular shoulder/flange extension 250/450 of the plasma confinement tube 218/418 from the annular seat 241 of the plasma exit nozzle 240. Then the plasma confinement tube 218/418 can be pulled outwardly in the direction 222 along with the tubular insert 216/416, dislodging the upstream end of the plasma confinement tube 218/418 from the annular seat of the gas distributor head 202, and dislodging the insert 216/416 from the inner surface 212/412 of the downstream section 208/408 of the tubular torch body 204/404. After the plasma confinement tube 218/418 and the insert 216/416 have been removed from the inside of the tubular torch body 204/404, the tubular insert 216/416 can be dismantled from the plasma confinement tube 218/418 by separating its two complementary semi-cylindrical sections 216A, 216B/416A, 416B from each other at the axial cuts 454 (FIG. 7*b*). It should be noted that the inner diameter of the tubular torch body 404 at the annular shoulder 414 is large enough to allow the upstream section of the plasma confinement tube 418, having a larger outer diameter, to slide out of the tubular torch body 404.

A new plasma confinement tube 218/418 can then be mounted in the induction plasma torch 200/400. For that purpose, the complementary semi-cylindrical sections 216A, 216B/416A, 416B of the insert 216/416 are assembled together at the axial cuts 454 and placed in position onto the new plasma confinement tube 218/418. The assembly insert/plasma confinement tube is then introduced within the tubular torch body 204/404 through the downstream end of this tubular torch body; the insert 216/416 is slid in position on the inner surface 212/412 of the downstream section 208/408 of the tubular torch body 204/404, and the upstream end of the plasma confinement tube 218/418 is placed on the annular seat of the gas distributor head 202. Finally the plasma exit nozzle 240 is mounted on the tubular torch body 204/404 with the outward, annular shoulder/flange extension 250/450 in the annular seat 241.

Those of ordinary skill in the art will realize that the description of the induction plasma torch and of the plasma confinement tube replacement method are illustrative only and are not intended to be in any way limiting. Other embodiments will readily suggest themselves to those of ordinary skill in the art having the benefit of the present disclosure. Furthermore, the disclosed induction plasma torch and plasma confinement tube replacement method may be customized to offer valuable solutions to existing needs for increasing energy density in plasma while reducing or eliminating stray-arcing in induction plasma torches.

In the interest of clarity, not all of the routine features of the implementations of the induction plasma torch and of the plasma confinement tube replacement method are shown and described. It will, of course, be appreciated that in the development of any such actual implementation of the induction plasma torch and of the plasma confinement tube replacement method, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of induction plasma torches having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. An induction plasma torch, comprising:

a tubular torch body having an upstream section and a downstream section, the upstream and downstream sections defining respective inner surfaces;

a plasma confinement tube disposed within the tubular torch body, coaxial with the tubular torch body, and having an inner surface of constant inner diameter and an outer surface, wherein the plasma confinement tube has a tubular wall with a thickness tapering off in an axial direction of plasma flow over at least a section of the plasma confinement tube;

a tubular insert mounted within the tubular torch body and having an outer surface applied to the inner surface of the downstream section of the tubular torch body, the tubular insert having an inner surface; and an annular channel defined between (a) the inner surface of the upstream section of the tubular torch body and the inner surface of the tubular insert, and (b) the outer surface of the plasma confinement tube, the annular channel being configured to conduct a cooling fluid for cooling the plasma confinement tube.

2. The induction plasma torch of claim 1, comprising an inductive coupling member embedded inside the tubular torch body for applying energy to a plasma gas present in the plasma confinement tube to produce and sustain plasma.

3. The induction plasma torch of claim 2, wherein the inductive coupling member comprises a coaxial coil and wherein the thickness of the tubular wall of the plasma confinement tube tapers off in the region of the coaxial coil.

4. The induction plasma torch of claim 1, wherein the inner surface of the upstream section of the tubular torch body, the inner surface of the tubular insert, and the outer surface of the plasma confinement tube are configured to define the annular channel with a constant thickness.

5. The induction plasma torch of claim 1, wherein the tubular torch body comprises an annular shoulder between the inner surface of the upstream section and the inner surface of the downstream section, and wherein the tubular insert comprises an upstream end abutting against the annular shoulder.

6. The induction plasma torch of claim 1, wherein:

the plasma confinement tube defines an outer, upstream cylindrical surface portion, an outer, central frusto-conical surface portion, and an outer, downstream cylindrical surface portion; and the inner surface of the upstream section of the tubular torch body is cylindrical and faces the outer, upstream cylindrical surface portion of the plasma confinement tube; and the inner surface of the tubular insert comprises an upstream frusto-conical surface portion facing the outer, central frusto-conical surface portion of the plasma confinement tube, and a downstream cylindrical surface portion facing the outer, downstream cylindrical surface portion of the plasma confinement tube.

7. The induction plasma torch of claim 1, comprising an inner capacitive shield including a layer of electrically conductive material on an inner wall of the tubular torch body, wherein the layer of conductive material is segmented into axial strips and defines a ring for interconnecting upstream ends of the axial strips.

8. The induction plasma torch of claim 7, wherein the capacitive shield is embedded into the inner wall of the tubular torch body, and wherein the tubular torch body has a smooth inner surface resulting from machining the capacitive shield along with the inner wall of the tubular torch body to expose the layer of electrically conductive material.

9. The induction plasma torch of claim 7, wherein the layer of electrically conductive material comprises a tube of said electrically conductive material.

10. An induction plasma torch, comprising:

a tubular torch body having an upstream section, a central section and a downstream section, the upstream, central and downstream sections defining respective inner surfaces;

a plasma confinement tube disposed within the tubular torch body, coaxial with the tubular torch body, and having an inner surface of constant inner diameter and an outer surface, wherein the plasma confinement tube has a tubular wall with a thickness tapering off in an axial direction of plasma flow over at least a section of the plasma confinement tube;

a tubular insert mounted within the tubular torch body and having an outer surface applied to the inner surface of the downstream section of the tubular torch body, the tubular insert having an inner surface; and an annular channel defined between (a) the inner surface of the upstream section of the tubular torch body, the inner surface of the central section of the tubular torch body, and the inner surface of the tubular insert, and (b) the outer surface of the plasma confinement tube, the annular channel being configured to conduct a cooling fluid for cooling the plasma confinement tube.

11. The induction plasma torch of claim 10, comprising an inductive coupling member embedded inside the tubular torch body for applying energy to a plasma gas present in the plasma confinement tube to produce and sustain plasma.

12. The induction plasma torch of claim 11, wherein the inductive coupling member comprises a coaxial coil and wherein the thickness of the tubular wall of the plasma confinement tube tapers off in the region of the coaxial coil.

13. The induction plasma torch of claim 10, wherein the inner surface of the upstream section of the tubular torch body, the inner surface of the central section of the tubular torch body, the inner surface of the tubular insert, and the outer surface of the plasma confinement tube are configured to define the annular channel with a constant thickness.

14. The induction plasma torch of claim 10, wherein the tubular torch body comprises an annular shoulder between the inner surface of the central section and the inner surface of the downstream section, and wherein the tubular insert comprises an upstream end abutting against the annular shoulder.

15. The induction plasma torch of claim 10, wherein:

the plasma confinement tube defines an outer, upstream cylindrical surface portion, an outer, central frusto-conical surface portion, and an outer, downstream cylindrical surface portion; and the inner surface of the upstream section of the tubular torch body is cylindrical and the inner surface of the central section of the tubular torch body is frusto-conical;

the inner surface of the tubular insert comprises an upstream frusto-conical surface portion forming with the inner, frusto-conical surface of the central section of the tubular torch body an inner uniform frusto-conical surface, and a downstream cylindrical surface portion;

wherein (a) the inner cylindrical surface of the upstream section of the tubular torch body faces the upstream cylindrical surface portion of the plasma confinement tube, (b) the inner uniform frusto-conical surface faces the outer, central frusto-conical surface portion of the plasma confinement tube, and (c) the downstream cylindrical inner surface portion of the tubular insert faces the outer, downstream cylindrical surface portion of the plasma confinement tube.

16. The induction plasma torch of claim 10, comprising an inner capacitive shield including a layer of electrically conductive material on an inner wall of the tubular torch body, wherein the layer of conductive material is segmented into axial strips and defines a ring for interconnecting upstream ends of the axial strips.

17. The induction plasma torch of claim 16, wherein the capacitive shield is embedded into the inner wall of the upstream and central sections of the tubular torch body, and wherein the tubular torch body has a smooth inner surface resulting from machining the capacitive shield along with the inner surfaces of the upstream and central sections of the tubular torch body to expose the layer of electrically conductive material.

18. The induction plasma torch of claim 16, wherein the layer of electrically conductive material comprises a tube of said electrically conductive material.

19. The induction plasma torch of claim 1, comprising:

a cooling fluid inlet for supplying cooling fluid to the annular channel; and a cooling fluid outlet for evacuating cooling fluid from the annular channel.

20. The induction plasma torch of claim 19, wherein the cooling fluid inlet and outlet are positioned so that the cooling fluid flows in the annular channel in a direction opposite to the direction of plasma flow.

21. The induction plasma torch of claim 1, wherein the plasma confinement tube is made of a material permeable to the cooling fluid, a fraction of the cooling fluid permeating through the material of the plasma confinement tube to form a film of the cooling fluid on the inner surface of the plasma confinement tube, the cooling fluid from the film being vaporized by heat produced by plasma, the cooling fluid being selected to form, when vaporized, gas capable of producing plasma.

22. The induction plasma torch of claim 1, wherein the plasma confinement tube comprises a downstream end provided with an outward, annular shoulder/flange extension, and wherein the induction plasma torch comprises an annular plasma exit nozzle mounted to a downstream end of the tubular torch body and comprising an annular seat to receive the outward, annular shoulder/flange extension.

23. The induction plasma torch of claim 22, wherein the annular shoulder/flange extension defines an annular shoulder on which a downstream end of the tubular insert abuts to retain the annular insert in the induction plasma torch on the inner surface of the downstream section of the tubular torch body.

24. The induction plasma torch of claim 1, wherein the tubular insert comprises at least two complementary sections encircling the plasma confinement tube.

25. The induction plasma torch of claim 24, wherein the complementary sections of the tubular insert comprises two semi-cylindrical sections.

* * * * *